US005810022A

United States Patent [19]

Reynolds

[11] Patent Number: 5,810,022

[45] Date of Patent: Sep. 22, 1998

[54] DEVICE AND METHOD FOR THE HOLDING OF AND THE COVERING OF THE ENDS OF BRAIDS WITH ATTACHABLE DECORATIVE OR ORNAMENTAL ASSEMBLY

[76] Inventor: Anne L. Reynolds, 1807 Downey St., Radford, Va. 24141

[21] Appl. No.: 967,300

[22] Filed: Oct. 10, 1997

[51] Int. Cl.[6] ..... A45D 24/00

[52] U.S. Cl. ..... 132/200; 132/273; 132/212

[58] Field of Search ..... 132/273, 275, 132/274, 222, 200, 212; D28/39, 41; 29/241, 443; 54/82, 78; 223/48; 119/850

[56] References Cited

U.S. PATENT DOCUMENTS

| | | | |
|---|---|---|---|
| 120,794 | 5/1871 | Ziska . | |
| 316,310 | 4/1885 | Eyck . | |
| 2,924,228 | 2/1960 | McGee . | |
| 3,295,535 | 1/1967 | Amato . | |
| 3,441,032 | 4/1969 | Barrett . | |
| 3,551,959 | 1/1971 | Mastalski . | |
| 4,317,337 | 3/1982 | Walden et al. . | |
| 4,406,296 | 9/1983 | Wexler et al. . | |
| 4,453,291 | 6/1984 | Fidrych . | |
| 4,712,389 | 12/1987 | Innis . | |
| 5,136,755 | 8/1992 | Shaw . | |
| 5,279,255 | 1/1994 | Northcutt | 132/212 |
| 5,329,789 | 7/1994 | Mandelbaum . | |
| 5,404,892 | 4/1995 | Bretl | 132/212 |
| 5,465,741 | 11/1995 | Dvorak . | |
| 5,472,003 | 12/1995 | Frame et al. | 132/273 |
| 5,581,992 | 12/1996 | Borouchov . | |
| 5,694,750 | 12/1997 | Allen | 132/273 |
| 5,706,837 | 1/1998 | Iwata | 132/212 |
| 5,730,161 | 3/1998 | Kohanek | 132/212 |

*Primary Examiner*—Gene Mancene
*Assistant Examiner*—Pedro Philogene
*Attorney, Agent, or Firm*—Robert E. Bushnell, Esq.

[57] ABSTRACT

This invention is for a new decorative hair ornament, a braidlet, and a method to attach it to one's hair. The braidlet is a tube-like device that covers the ends of braids and also allows for further ornamentation to be hung from the tubes. This invention adds another option for both men and women trying to style or decorate their hair. The versatility of the ornamentation allows for it to be easily removable and adjustable. The braidlet is simply constructed and therefore can be made to suit ones tastes, according to the amount of money one wished to spend. As such, the braidlet can be enjoyed by both children and adults.

17 Claims, 4 Drawing Sheets

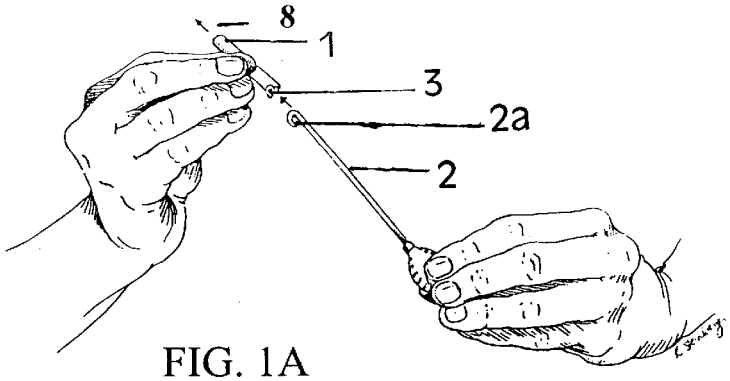
FIG. 1A
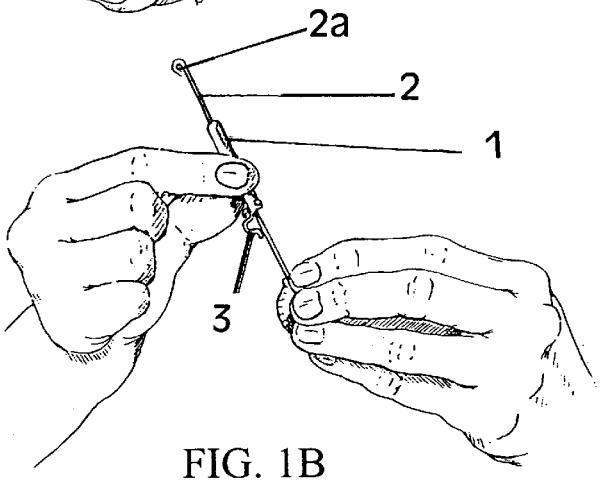
FIG. 1B
FIG. 1C
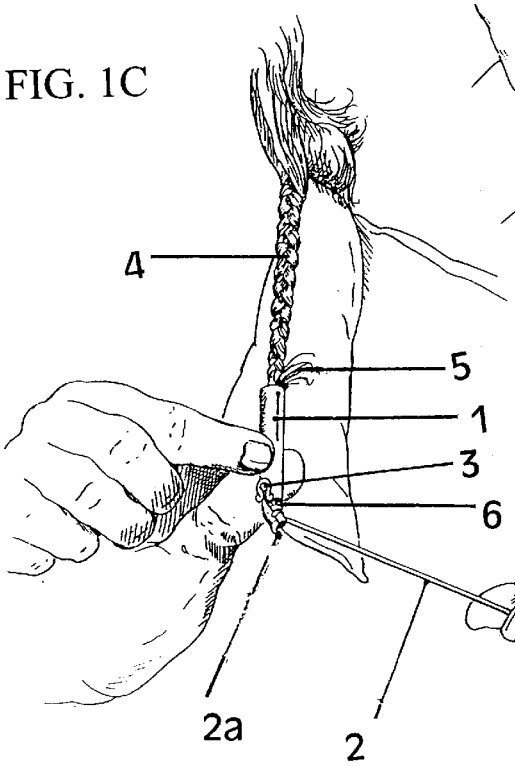
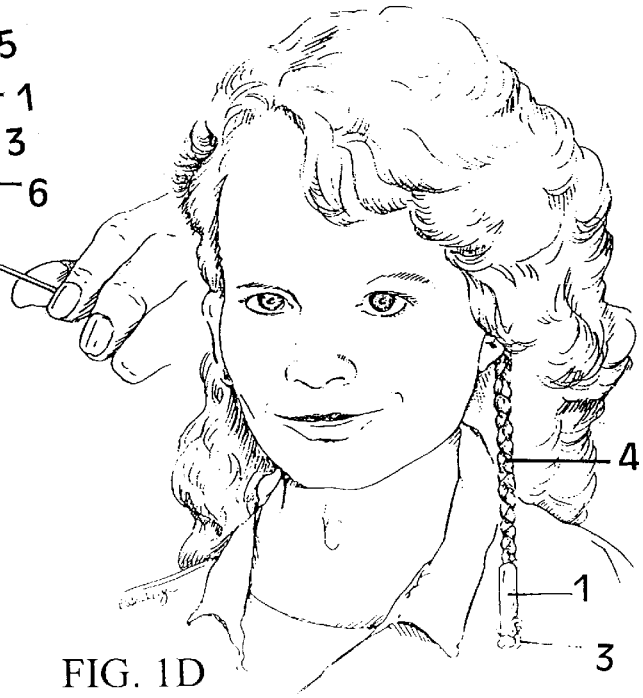
FIG. 1D

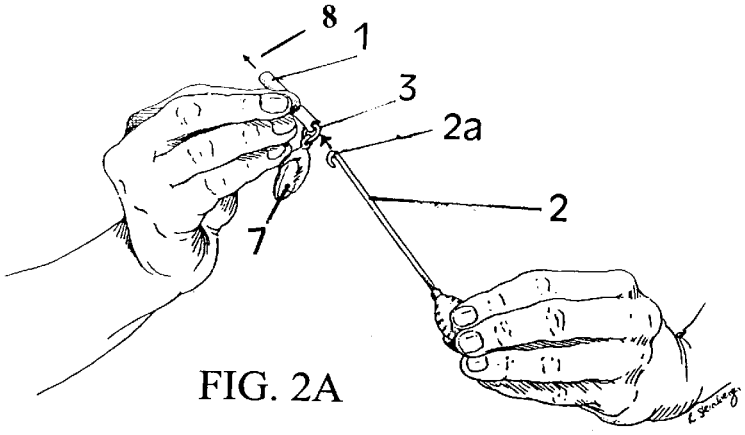
FIG. 2A
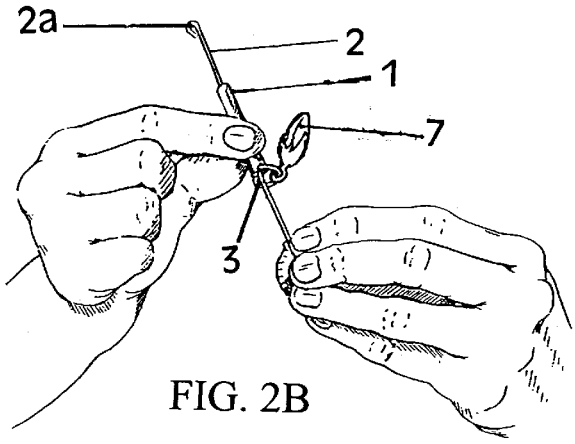
FIG. 2B
FIG. 2C
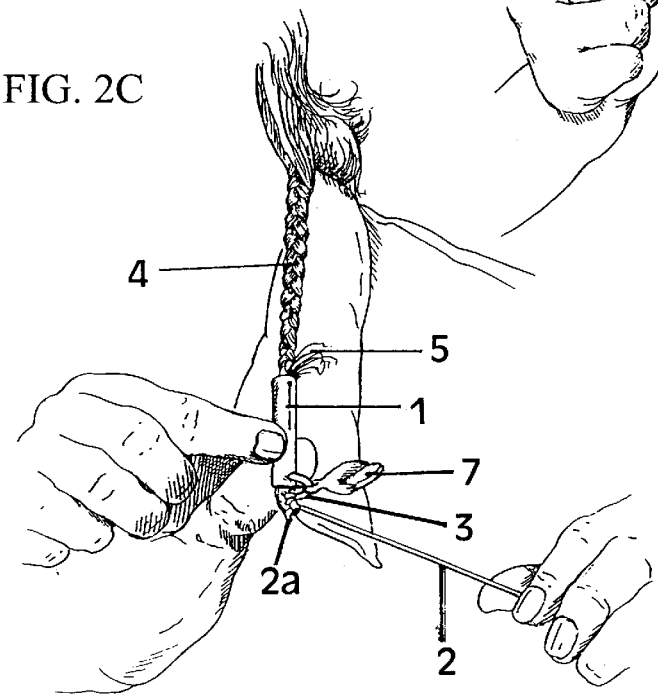
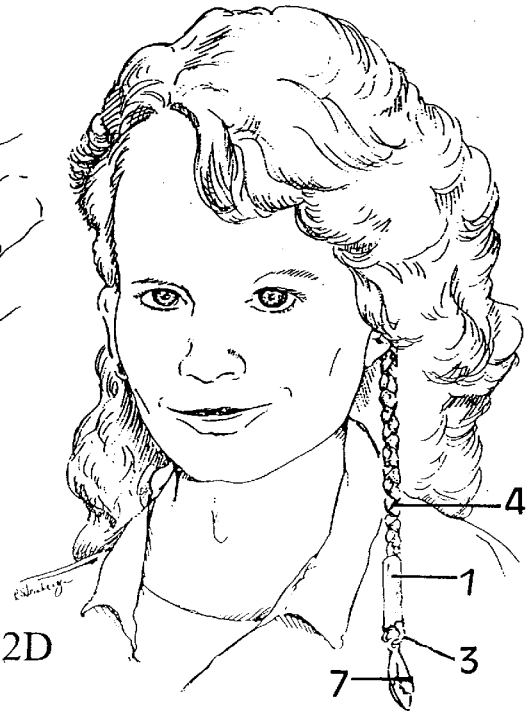
FIG. 2D

DEVICE AND METHOD FOR THE HOLDING OF AND THE COVERING OF THE ENDS OF BRAIDS WITH ATTACHABLE DECORATIVE OR ORNAMENTAL ASSEMBLY

BACKGROUND OF THE INVENTION

1. Field of the invention

The present invention relates to hair styling equipment and, more specifically, to a device and a method for holding braids in place while covering the ends of the braids with the decorative device that can have other ornamental jewelry or assembly attached.

2. Background art

The adornment of one's hair has been a an area of much creativity over the decades. In 1885, U.S. Pat. No. 316,310 to Ten Eyck entitled *Clamp for confining the Ends of Braid,* mentions a clamp for confining the ends of a braid. This rather crude device relied on springs and clamps and was constructed using two clamping parts. U.S. Pat. No. 2,924, 228 to McGee entitled *Ladies' Hair Clasp Device,* shows a hair clasp device for holding pony tails constructed using a helical coil. This device required that the coiffure portion of a woman's hair pass through the adjacent springs whenever one attached or removed the clasp.

A hair wrap device for holding gathered hair is also shown in U.S. Pat. No. 5,465,741 to Dvork entitled *Hair Wrap Device.* This device is a pliable wrap that uses pressure from the same string that compresses the wrap and the hair together. The device requires the tying and winding of string around the wrap.

U.S. Pat. No. 4,317,337 to Walden entitled *Clasp for Glowing Liquid Filled Tubular Jewelry,* shows tubes used to create jewelry by filling the tubes with liquid. A frictional connection attaches the clasp to both ends of the tube. This use of a frictional connection is meant as a permanent connection. The use of tubes to make jewelry is also disclosed in U.S. Pat. No. 5,329,789 to Mandelbaum entitled *Jewelry with Tubular Appearance,* where half tubes are used to give the appearance of full tubes and thus provide a heavier look at a lower actual weight and cost.

The use of a hook to draw horse hair through the interior of a cylinder to facilitate the banding of the horses mane is found in U.S. Pat. No. 5,279,255 to Northcutt entitled *Horse Hair Banding Device.* The Northcutt '255 hook is used to group hair so that it can be bound at its point of origination, rather than trying to attach an ornament to the end of a group of hair.

A hook is disclosed for drawing human hair through a vial in U.S. Pat. No. 3,295,535 to Amato entitled *Apparatus for Tipping Hair Including a Tube for Receiving a Tuft of Hair and Having an Expansion Chamber.* Amato '535, however, is part of an apparatus for treating the tips of one's hair. The use of jewelry system that attaches to the cylindrical beads as part of a jewelry system is shown in U.S. Pat. No. 4,406,296 to Wexler entitled *Jewelry System.* The beads used are movable, on a string, and can be fastened into place by a combination of male and female connectors.

U.S. Pat. No. 3,441,032 to Barrett entitled *Hair Ornament,* discloses the use of elongated flexible members to attach hair ornaments to typical hair rollers. The ornaments in the '032 patent are supported by the rollers and the hair that is wrapped around the rollers.

I have observed many problems with the hair ornamentation art. Some devices do not function very well when worn on the ends of one's hair. I have further observed that some hair ornaments are difficult to adjust if one decides to adjust the ornament's location. Other devices are just very difficult to remove from one's hair. Few devices use a non permanent frictional means to stay on one's hair.

As noted above, although there are many hairstyling devices in the prior art that are suitable for creating a particular hairdo or effect. However, I expect that a hair ornamentation device that is one-piece, is a hollow cover for the ends of a grouping of hair, that is easily attachable and removable, uses only a frictional holding means for the ornament itself, that has a connector for the attachment of additional assembly, and that is economical to construct and attractive to the eye would add a new addition to one's hairstyling choices.

SUMMARY OF THE INVENTION

It is an object of the current invention to provide a device that can decorate one's hair while covering the ends of a grouping of hair.

It is another object to provide an ornamental hair piece that is quick and easy to attach, adjust and remove.

It is still another object to provide an ornamental device that covers the ends of one's hair with a tube that has no apparent means of attachment.

It is yet another object to provide a method for placing hair inside of a hollow tube and for securing the tube to the grouped hair using only a frictional holding means.

It is still yet another object to provide an attractive and economic hair ornamentation alternative.

These and other objects may be achieved by using a the disclosed hollow tube device for a hair ornament. The hollow tube, also called a braidlet, covers the ends of the grouped hair. Due to its frictional holding means the braidlet can be adjusted with a gentle tug, or just as easily removed. The method for attaching the braidlet to grouped hair is also extremely quick and easy. To attach the braidlet one hooks the cord grouping the hair using the braidlet hook and pulls the braid and the cord inside the hollow braidlet. As the braidlet is made out of one rigid hollow cover piece it is not possible to see how the braidlet is attached. The apparent lack of any attachment device adds to the overall attractiveness of the hair ornament. The braidlet is actually supported on one's hair by the frictional forces caused by the contact between the cord grouping the hair and the interior surface of the braidlet. Using a frictional holding means facilitates adjusting the braidlet to the proper location on one's hair.

BRIEF DESCRIPTION OF THE DRAWINGS

A more complete appreciation of this invention, and many of its attendant advantages thereof, will be readily apparent as the same becomes better understood by reference to the following detailed description when considered in conjunction with the accompanying drawings in which like reference symbols indicate the same or similar components, wherein:

FIG. 1A shows a braidlet, without an attached ornamental piece.

FIG. 1B shows the braidlet hook after having been placed through the hollow interior of a braidlet that has its loop partially detached in order to keep out of the way of the braidlet hook.

FIG. 1C shows a braid after being pulled through the interior of the braidlet using the braidlet hook.

FIG. 1D shows the braidlet, without any attached ornament, being worn after the necessary adjustment was made so that the braidlet covers the end of the braid.

FIG. 2A shows a braidlet, with an attached ornamental piece. The ornamental piece is held at an angle to avoid interfering with the passage of the braidlet hook and the arrows denote the direction in which the braidlet hook is to be pushed in order to prepare for attaching the braidlet hook to a braid.

FIG. 2B shows the braidlet hook after having been placed through the interior of the braidlet.

FIG. 2C shows a braid after being pulled through the interior of the braidlet using the braidlet hook and it shows the proper position of any ornaments or attachments while pulling the braid through the braidlet.

FIG. 2D shows the braidlet, with an attached ornament, being worn in the proper position after making the proper adjustments.

DETAILED DESCRIPTION OF THE PREFERRED EMBODIMENTS

Turning now to the drawings, particularly FIGS. 1A–1D, showing how one embodiment of the hair braidlet is attached and worn. The method for attaching a braidlet to one's hair is to first set one's hair in a braid and secure it with an elastic band or cord (not shown). The outer diameter of the braided hair and securing cord should be slightly less than that of the inner diameter, or shortest cross sectional distance, of the braidlet. Of course, the braidlet need not be in a tubular form, but can also be in a triangular, square, or hexagonal shape, etc. Then, as shown in FIG. 1A, the braidlet is held with the loop 3 in a orientation that prevents the loop 3 from interfering with the passage of the braidlet hook 2. Then the braidlet hook 2 is passed through the braidlet. During this process, any ornamentation 7 attached to loop 3 should be held in an orientation that does not obstruct the passage of the braidlet hook, shown in FIG. 4. If there is no ornamentation attached to the loop 3, then the loop can be detached as shown in FIG. 1B to facilitate the passage of the braidlet hook 2. Once the hook portion 2*a* of the braidlet hook is through the braidlet, as shown in FIGS. 1B and 2B, the upper hook portion 2*a* must be attached to the securing cord. Then, the user pulls the braidlet hook back out of the braidlet in the opposite direction indicated by the arrow 8, shown in FIGS. 1A and 2A, and thereby pulls the braid into the braidlet. Once the upper hook portion comes out of the braidlet with the braid one can release the braidlet hook by simply twisting and lifting the hook away from the securing cord. The braidlet is fastened in place by the frictional force between the inner surface of the braidlet and the braid's securing cord.

Figure 4:
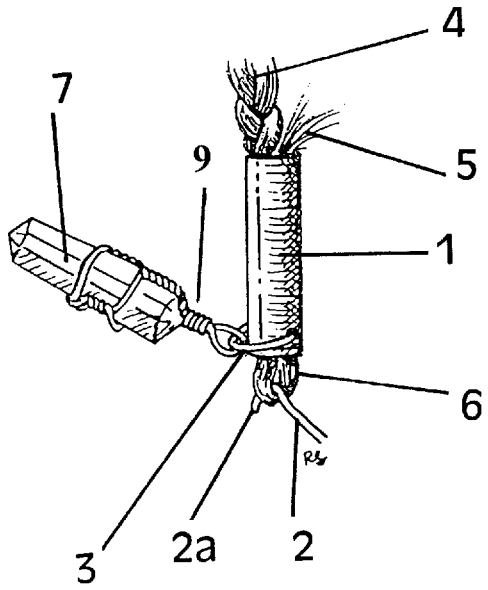
FIG. 4 shows the proper orientation of both the hoop (used for attaching additional assembly) and an exemplary ornament so that neither interfere with the passage of the braidlet hook.

If after detaching the braidlet hook part of the braid 6 is still showing from the lower end of the braidlet, as shown in FIG. 4, then the braidlet can be adjusted by applying a gentle downward tug. If any hair 5 is showing from the top of the braidlet then it can be trimmed. An attached braidlet is shown in FIGS. 1D and 2D. The hair braidlet is an ornamental hair device which covers the end of a braid. The device is easily attached and can be adjusted or removed by simply tugging on the braidlet. This is due to the frictional holding means used to secure the braidlet to one's hair.

Figure 3:
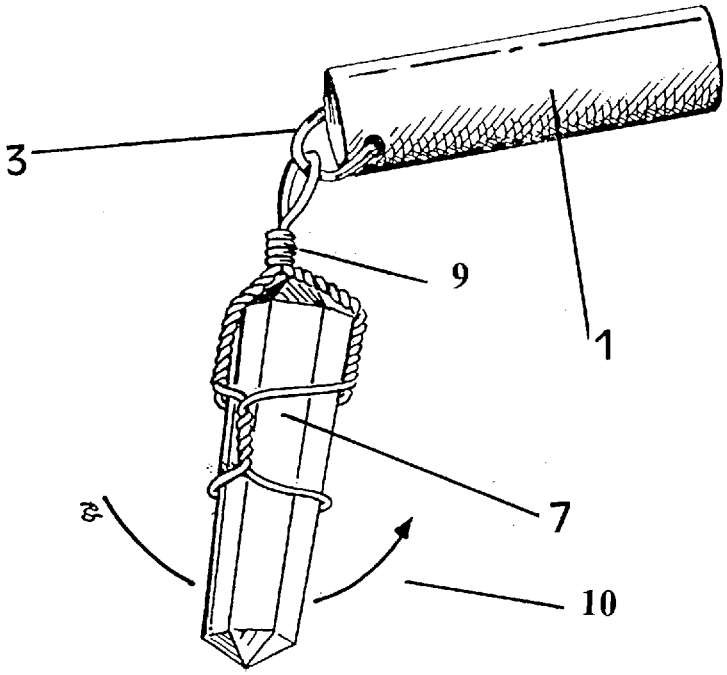
FIG. 3 shows the mechanism for the attachment of jewelry to the braidlet and one of its ranges of motion.

The braidlet 1 along with exemplary additional ornamentation 7 and ornamentation connector 9 is shown in FIG. 3. The additional ornamentation, also referred to as assembly, is attached to a loop 3 which is part of the braidlet. The rotatable nature of the loop and the portability of the ornament 7 along it allows the assembly to move to any side of the braidlet and thereby facilitates the attaching of the braidlet. One plane of rotation is shown in FIG. 3 by arrow 10.

The braidlet can be made of any rigid substance, plastic, wood, composite or metal. The design of the braidlet makes it easy to construct and depending on choice of material it can be either or both a fancy and cheap hair ornament.

Figure 5:
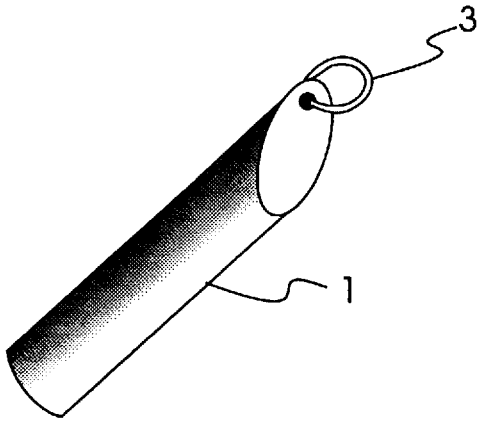
FIG. 5 shows a braidlet as constructed according to the principles of the present invention.

The simplicity of the design, as shown in FIG. 5, makes the braidlet a very economical hair ornament which can be made with finer workmanship and materials if one wishes to have a fine piece of jewelry for a hair ornament. For young children who want to wear earrings but are too young or have ears that are too sensitive to be pierced, the proper placement of a braidlet on the right length braid of hair can appear to be an earring.

This is only one preferred embodiment and the invention includes all obvious alterations made by one skilled in the art after reviewing this disclosure in its entirety.

What is claimed is:

1. A device for covering and securing an end of a group of hair comprising:

a hollow tube having a connecting device on one distal end, said connecting device pivotally attached and supporting an additional assembly;

said hollow tube supported by a frictional force between a cord that secures the group of hair and the inner surface of said hollow tube; and a hooking instrument that pulls the group of hair through the inside of the hollow tube.

2. The device according to claim 1, with said hollow tube further comprising any one of the following shapes: triangular, square, hexagonal or circular, when the perimeter of an opening is viewed from one distal end.

3. The device according to claim 1, with said connecting device being a loop that is attached to said hollow tube, said loop supporting said additional assembly, said loop rotating outside of the projected area within the inner circumference of said hollow tube in allowing a hooking instrument to pass through said hollow tube without interference from said loop.

4. The device according to claim 1, wherein said connecting device is a loop that is attached to a hollow tube at one distal end of said hollow tube and the loop can detach from said hollow tube and thereby avoid blocking the projected area within the inner circumference of said hollow tube in order to allow a hooking instrument to pass through said hollow tube without interference from the loop.

5. The device according to claim 1, further including said cord being any one of the following: a rope, a rubber band or a similar elastic material, thereby increasing the frictional interaction between said cord or rope and the inner surface of a hollow tube.

6. The device according to claim 1, further including said additional assembly that is any one of the following: ornament, electronics, contained luminescent liquid or jewelry, according to the preferences of the user.

7. The device according to claim 1, further including said hollow tube positioned along a grouping of hair so as to do either one of the following: cover the ends of the group of hair or to allow hair to protrude from both openings, as desired by the user.

8. The device according to claim 1, with said hooking instrument having a hook located at a distal end of a rod.

9. The device according to claim 1, with said hollow tube having an interior surface that is made uneven to increase the friction between said cord and the interior of said hollow tube.

10. A device for holding an end of braided hair in a braid, comprising:

a hollow cylindrical tube, also called a braidlet, that has braided hair pulled through one opening on a distal end of said braidlet;

a loop attached to an opening of said braidlet, said loop attached on a side opposite from that used for the entry of said braid into said braidlet, said loop supporting an additional ornamentation;

said braidlet being fixed in place by a frictional force between an elastic band and the inner surface of said braidlet, said elastic band holding said braid together; and a hooking instrument attaching to said elastic band, and puling said braid and said elastic band inside the hollow cylindrical tube.

11. The device according to claim 10, with said loop pivotally attached to a braidlet to enable said loop to rotate outside of the projected area within the inner circumference of the braidlet and allow a hooking instrument to pass through said braidlet without interference from said loop.

12. The device according to claim 10, with said loop being detachable from said braidlet, said loop thereby enabling a hooking instrument to pass through the braidlet without interference from said loop.

13. The device according to claim 10, with said hooking instrument having a hook located at a distal end of a rod.

14. The device according to claim 10, with said braidlet having an uneven inner surface to increase said frictional force between said elastic band and the inner surface of said braidlet.

15. The device according to claim 10, with said additional assembly being any one of the following: ornament, electronics, contained luminescent liquid or jewelry, according to the preferences of the user.

16. A process for attaching groupings of hair to a braidlet that can also support additional assembly comprising the steps of:

wrapping an end of a grouping of hair in a cord, so that when said cord is in contact with the inside of said braidlet a frictional force will hold said braidlet in place over said grouping of hair;

passing a hooking instrument through the braidlet and attaching said hooking instrument to said cord;

pulling said hooking instrument, an attached grouping of hair, and said cord into said braidlet;

disengaging said hooking instrument from said cord;

make any adjustments to said braidlet by giving a gentle tug to said braidlet and trimming any stray hairs protruding from the top of said braidlet; and attaching any desired additional assembly to said braidlet.

17. A process according to claim 16, where the step of passing said hooking instrument through said braidlet and attaching said hooking instrument to said cord, comprises the steps of:

inserting said hooking instrument through said braidlet, said hook attaching to the middle of said cord and drawing said grouping of hair inside said braidlet by pulling the hooking instrument in a direction opposite that used for said hooking instrument's original insertion;

twisting said hooking instrument and releasing said cord; and pulling said hooking instrument back out an opening opposite from that used for the entry of said grouping of hair to remove said hooking instrument.

* * * * *